US006398387B1

(12) United States Patent
Wienhold

(10) Patent No.: US 6,398,387 B1
(45) Date of Patent: Jun. 4, 2002

(54) ICICLE LIGHT CANDY CANE

(75) Inventor: Robert Wienhold, 5979 Paine Rd., LeRoy Township, OH (US) 44077

(73) Assignee: Robert Wienhold, LeRoy, OH (US)

( * ) Notice: Subject to any disclaimer, the term of this patent is extended or adjusted under 35 U.S.C. 154(b) by 0 days.

(21) Appl. No.: 09/748,095

(22) Filed: Dec. 27, 2000

(51) Int. Cl.[7] ..... F21P 1/00

(52) U.S. Cl. ..... 362/231; 362/249; 362/252; 362/806; 362/808

(58) Field of Search ..... 362/230, 231, 362/249, 252, 806, 808, 391

(56) References Cited

U.S. PATENT DOCUMENTS 5,317,238 A * 5/1994 Schaedel ..... 315/323
5,359,506 A * 10/1994 Koleno ..... 362/248
5,624,181 A * 4/1997 Miller et al. ..... 362/808
5,860,731 A * 1/1999 Martinez ..... 362/252
5,911,501 A * 6/1999 Katz ..... 362/267
5,957,564 A * 9/1999 Bruce et al. ..... 362/84
6,050,701 A * 4/2000 Stone ..... 362/249
6,076,938 A * 6/2000 Kinderman ..... 362/249
6,126,181 A * 10/2000 Wu ..... 362/806

* cited by examiner

*Primary Examiner*—Thomas M. Sember

(57) ABSTRACT

A decorative ornament bearing the shape and structure of a typical candy cane is disclosed. The ornamental cane has a multiple of holes that pass completely through and are spaced somewhat uniformly along its length. The candy cane ornament consists of two separate colors in the form of two spiraling stripes. The overall concept is the illumination of the candy cane by a single downward strand of lights found on the typical icicle light set. Each of the light bulbs is inserted through the holes and projects out the other side, providing illumination. The order in which the light bulbs are attached allows the cane to be displayed in an upright position. The candy cane is permitted to suspend freely just as the adjacent downward strands of lights. Multiple quantities of candy cane ornaments may be attached to the icicle light set at various intervals.

18 Claims, 4 Drawing Sheets

ICICLE LIGHT CANDY CANE

BACKGROUND OF THE INVENTION

Over the years there have been many variations of decorative lighting systems using a multiple of figurines. Usually these figurines are designed to represent a specific holiday such as Christmas or Halloween. The figurines are generally made of plastic and may include a set of electric lights. Some examples are as follows:

U.S. Pat. No. 5,911,501 issued to Katz discloses a decorative lighting system comprising of hollow plastic figures that includes electrical couplers and electrical fittings to insert and attach light bulbs to the interior of the figure, whereby illumination is accomplished via light transmission.

U.S. Pat. No. 6,017,132 issued to Miller discloses a decorative light supporting structure that has the shape of a Christmas wreath or candy cane. The overall structure consists of a plurality of component members having light routing protrusions for wrapping a string of lights around the outside of the structure. The string of lights are to be routed back and forth between the light routing elements and are closely wound to depict the holiday item by shape and volume.

U.S. Pat. No. 4,833,580 issued to Allen discloses an illuminated hollow decorative ornament to be used as a source of diffused light when the light bulb is placed within the ornament.

U.S. Pat. No. 5,359,506 issued to Koleno discloses an all occasion light system, which provides electrically connected base members designed to insert a multiple of light bulbs along an electric cord. The electric cord, base members, and light bulbs are to be permanently installed to the home or the like. Ornaments designed to attach to the base members may be substituted with alternate ornaments designed for different holiday occasions.

U.S. Pat. No. 4,234,915 issued to Malinowski discloses a decorative light string set consisting of permanently connected hollow plastic ornaments. The light bulbs are inserted and held in position by a predetermined shaped neck opening on the ornaments and thereby are illuminated internally.

U.S. Pat. No. 6,076,938 issued to Kinderman discloses a frame member for suspending a plurality of sockets and light bulbs along an electric cord. Attached to the light bulb sockets are ornaments bearing the shape of realistic looking icicles.

BRIEF SUMMARY

Due to the popularity of "icicle" or "curtain lights" that are used for outdoor holiday decorating, particularly during the Christmas season, it is the goal of this invention to offer the homeowner another decorating option using their own existing light sets. Typically, multiple strings of these icicle lights are connected together and are hung along gutters and rooflines across the front of the home. Generally all of the bulbs used are clear. When illuminated, the overall effect is a simulation of glistening icicles. Icicle light sets that are designed for outdoor use are all weather approved and must meet certain safety standards. The invention described herein is a striped candy cane shaped ornament, formed of plastic, which includes a multiple of holes, spaced evenly along its length. The purpose of these holes is to accept the light bulbs of a downward strand from the icicle light set. It is recommended that the longest strand, containing the most bulbs be used. The bulbs enter in from the back and protrude beyond the face of the ornament. Clear bulbs are to be inserted in holes exiting on white stripes. Red bulbs will be substituted for clear bulbs when they are to be inserted in holes exiting on red stripes. Simple wire ties are used to secure the wires and bulbs to the candy cane. The homeowner is enabled to incorporate illuminated candy canes at various points along the entire roofline, giving new and exciting holiday appeal to the home.

DETAILED DESCRIPTION OF THE PREFERRED EMBODIMENT

The description to follow will allow any individual skilled in the art to make and use the invention described herein. It is the intention of the inventor to describe the best possible method to implement the invention. It may be readily apparent to those skilled in the art to make various modifications to the present invention.

Figure 1:
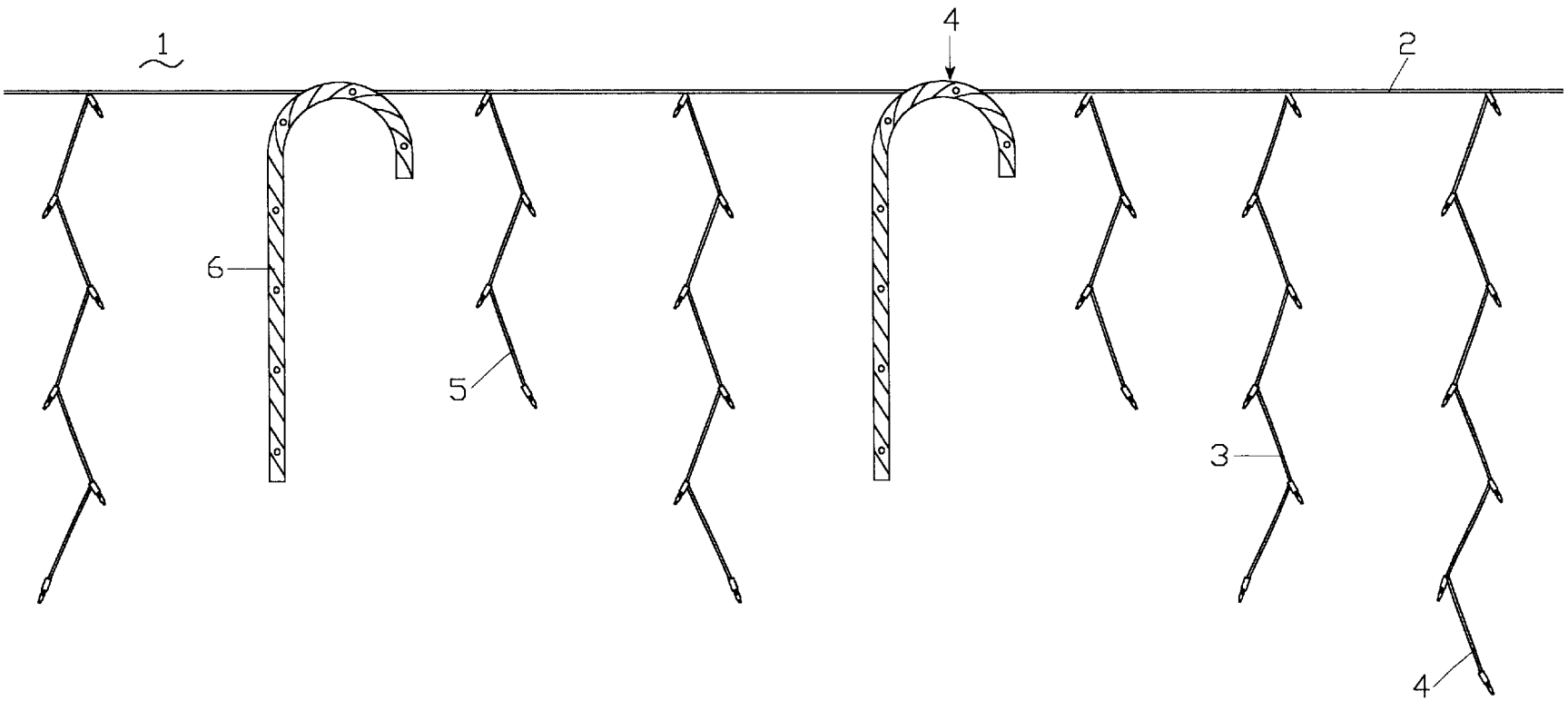
FIG. 1 is an artist's rendering showing an icicle light set mounted along a horizontal plane and includes two ornamental candy canes. Suggested mounting and placement of the ornaments is illustrated.

FIG. 1 introduces another option to the holiday lighting display by the way of illuminated candy cane ornaments that may be attached to the icicle light set 1 at various points along the light string 2. The candy cane members 6 include holes 9 designed to accept the insertion of light bulbs from a selected downward strand of icicle lights.

FIG. 1 shows a section of an icicle light 1 set that is mounted horizontally along a gutter or the like. This allows for the free hanging of the individual downward strands of light bulbs. Several ornamental candy canes are shown in the suggested mounting fashion. To fully understand the application of the invention, the design of the icicle light set 1 must be fully examined. Generally, the icicle light set 1 consists of a main electrical cord 2 disposed with light sockets 10 and bulbs 11 along its length. Extending transversely at various points and intervals are additional strands of lights created of twisted loops. The twisted loop takes on the appearance of a single downward strand of lights 3, 4, 5. Individual downward strands 3, 4, 5 are usually of different lengths and bulb quantities. A typical icicle light set 1 may exhibit the following pattern: seven bulbs per strand 4, four bulbs per strand 5, six bulbs per strand 3, etc. The majority of icicle light sets 1 are manufactured as previously described. It is recommended that the longest strands equipped with the most bulbs be used in conjunction with the candy cane member 6; thereby allowing for maximum illumination and visual appeal. Given the particular design described, candy cane ornaments may be included at selected intervals along the main electric cord 2 of the light set, thereby adding exciting holiday appeal to ones home or business.

Figure 2:
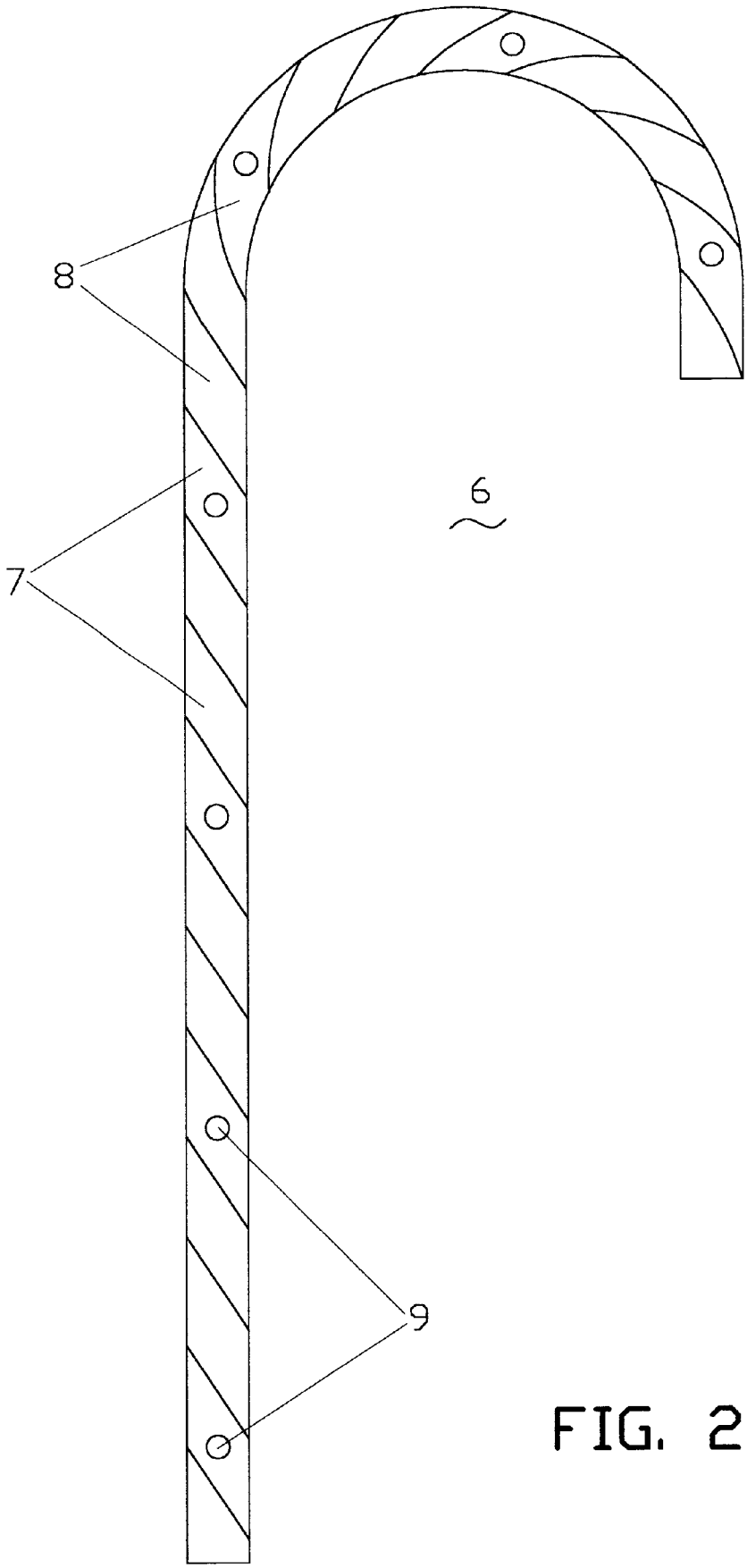
FIG. 2 is a perspective view showing an overall structure shaped like a candy cane that includes a typical striping pattern and light bulb mounting holes.

FIG. 2 shows a perspective view of the ICICLE LIGHT CANDY CANE for use with icicle light sets 1. Manufactured from a polymeric material, the candy cane member 6 may be both cut and thermoformed from stock material or may be injection molded. A suitable stock material can be either solid or tubular. The holes 9 shown are drilled or preformed as a part of the injection molding process. It is the intention to offer the first preferred embodiment in circular form, in regards to the dimensional volume, to best simulate an actual candy cane. The striping process consists of two parallel and continuous colored bands, spiraling from end to end, as found on the popular Christmas confectionery. It should be further noted that the striping is comprised of two separate pre-disposed colors. These colors may vary, however the ever-popular red and white will be the primary design pursued within this application. It is not the intention of this application to be limited by particular color choices; but only to point out what may be deemed most recognizable. Viewed from any given angle, the two separate colored stripes appear as two alternating colored sections 7, 8. The first colored section being referred to as red 7. The second section being referred to as white 8. Along the length of the candy cane member 6 in a curvilinear path is a plurality of openings or holes 9 that are uniform in size. The holes 9 are to be of particular diameter enabling them to accept the insertion of light bulbs 11 found on the icicle light set 1. FIG. 2 shows seven holes 9 along the length of the candy cane member 6 that accept the corresponding light bulbs 11 of a seven bulb strand 4. However, it is not the intention of this application to restrict the number of holes 9 to seven. Particular details of hole 9 locations in relation to colored sections 7, 8 are illustrated. It should be noted that holes 9 are located on alternating colored sections 7, 8. This particular view shows four of the holes 9 located on particular red sections 7. The remaining three holes 9 are located on particular white sections 8. The invention offers an option of reversing the direction a candy cane member 6 is installed. If a candy cane member 6 is turned over to view the opposite side, the relationship of holes 9 located on particular colored sections 7, 8 will be reversed. A hole 9 that enters into a red section 7 will exit from a white section 8 on the opposite side. Candy cane ornaments may be installed to face left or right. This feature offers the installer different combinations to choose from.

Figure 3:
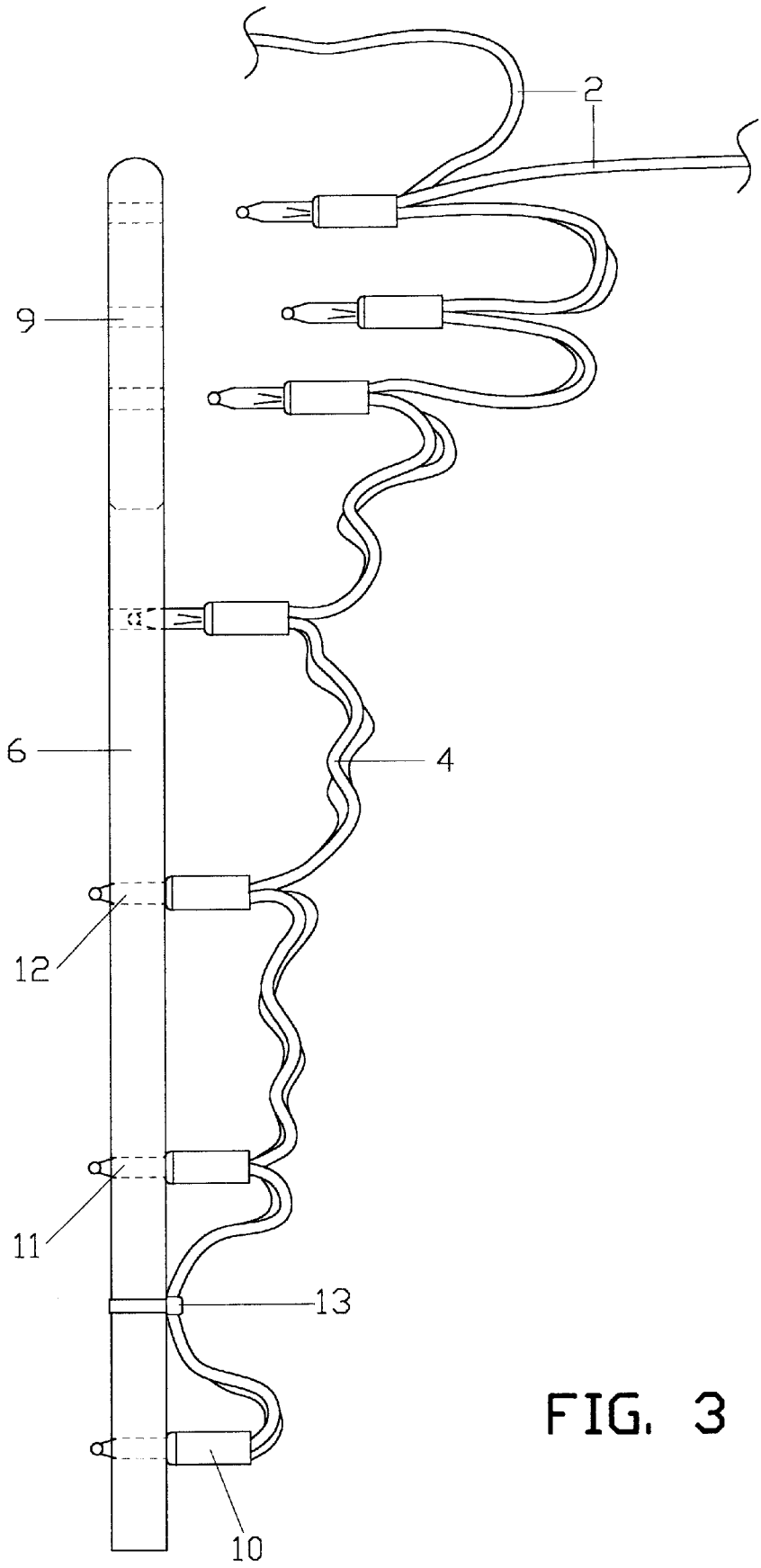
FIG. 3 is a side elevation in cross section of the candy cane member that illustrates the relative light bulb location and insertion from a single downward strand of an icicle light set.

FIG. 3 shows a cross sectional side elevation of the candy cane member 6. A single downward strand of icicle light bulbs 4 is shown in position to be, and having been installed into corresponding mounting holes 9. It is recommended that clear bulbs be substituted with red bulbs when they exit from holes 9 on red sections 7. An adequate supply of red bulbs 12 may be included with the product to allow the installer to make necessary adjustments prior to assembly. The overall diameter of the candy cane member 6 is illustrated as being such as to permit a portion of each bulb 11, 12 to protrude. This protrusion is such as to allow for maximum visibility and illumination of the ornament in two ways. Firstly, being direct visible light that can match the luminosity of all surrounding icicle light strands 3, 5 and secondly, the light reflections from the surface area of the candy cane member 6 where the light bulb 11, 12 protrudes. Proper vertical mounting of the candy cane member 6 is accomplished by the insertion of the first bulb 11, 12 found on the downward strand into the hole 9 closest to the top of the candy cane member 6. This hole 9 will be referred to as the starting point for bulb 11, 12 installation. Additional bulbs 11, 12 on the downward strand 4 are inserted into the proper corresponding holes 9. After all light bulbs 11, 12 have been installed into their proper locations, wire ties 13 are used to attach the downward strand 4 securely to the candy cane member 6. One wire tie 13 is installed at the halfway point between two bulbs 11, 12. All of the candy cane ornaments, after having been properly installed, are permitted to suspend freely and adjust as necessary to various rooflines, railings, etc.

Figure 4A:
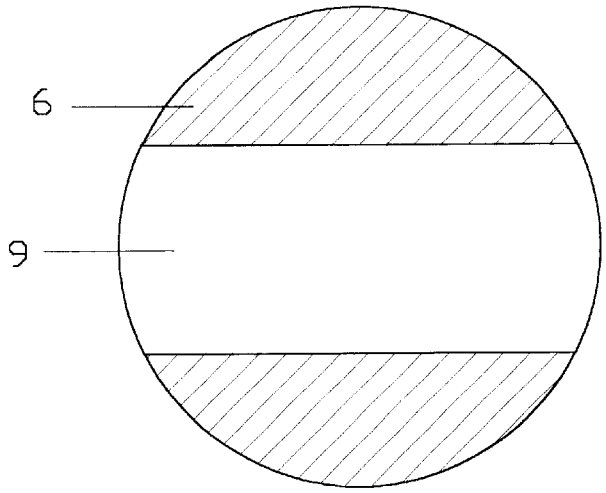
FIGS. 4A, 4B show a cross section of the first preferred embodiment, which is circular. A light bulb mounting hole that passes completely through the member is illustrated.
Figure 4B:
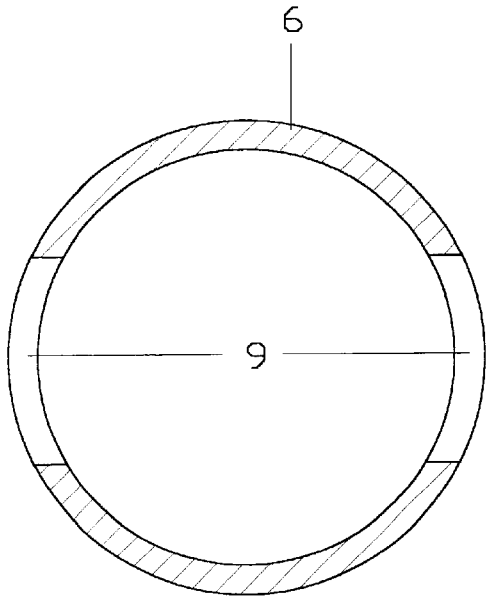

FIGS. 4A, 4B show a cross section of the first preferred embodiment of which the candy cane member 6 is circular. 4A being a solid member. 4B being a tubular member. Details of a light bulb mounting hole 9 are shown. The hole 9 is shown passing completely through the candy cane member 6.

Figure 5:
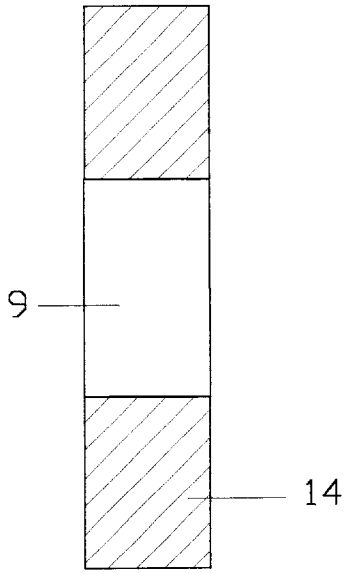
FIG. 5 is a cross section of the second preferred embodiment, which is rectangular and illustrates a light bulb mounting hole that passes completely through the member.

FIG. 5 shows a cross section of the second preferred embodiment of which the candy cane member 14 is rectangular. Details of a light bulb mounting hole 9 are shown. The hole 9 is shown passing completely through the candy cane member 14.

What is claimed is:

1. An apparatus comprising:

a string of icicle lights having a plurality of light bulbs disposed on a common electrical cord, said plurality of light bulbs including a first set of light bulbs that extend along said electrical cord in a longitudinal direction, said plurality of light bulbs further including a second set of light bulbs that extend in a transverse direction;

said first set of light bulbs comprising light bulbs of a first color;

said second set of light bulbs comprising light bulbs of said first color and light bulbs of a second color, said light bulbs of said first color and said second color being alternately disposed in said second set of light bulbs; and a member shaped in the form of a candy cane and made of a polymeric material, said member having oppositely disposed first and second ends, said member including a plurality of openings disposed in succession along a curvilinear path between said first and second ends, said plurality of openings for receiving said second set of light bulbs;

said plurality of openings including a first group of openings for receiving said light bulbs of said first color and a second group of openings for receiving said light bulbs of said second color, said openings in said first and second groups of openings being alternately disposed along said curvilinear path.

2. The apparatus of claim 1 wherein said member has a main body portion through which said plurality of openings extend, said main body portion including a plurality of alternately disposed first and second sections, each of said first sections of said main body being a third color, each of said second sections of said main body portion being a fourth color.

3. The apparatus of claim 2 wherein each of said first set of openings is located in one of said first sections of said main body portion and each of said second set of openings is located in one of said second sections of said main body portion.

4. The apparatus of claim 3 wherein each of said light bulbs of said first color in said second set of light bulbs are disposed in one of said openings in said first set of openings in one of said first sections of said main body portion, each of said light bulbs of said second color in said second set of light bulbs being disposed in one of said openings in said second set of openings in one of said second sections of said main body portion.

5. The apparatus of claim 2 wherein said first color of said light bulbs in said second set of light bulbs is a shade of white and said second color of said light bulbs in said second set of light bulbs is a shade of red, said third color of said first sections of said main body portion being a shade of white and said fourth color of said second sections of said main body portion being a shade of red.

6. The apparatus of claim 1 wherein said member has a circular cross-section being either solid or tubular.

7. The apparatus of claim 1 wherein said member has a rectangular cross-section.

8. The apparatus of claim 1 wherein said electrical cord extending between each of said light bulbs in said second set of light bulbs is secured to said member.

9. The apparatus of claim 1 wherein each of said plurality of openings in said member has oppositely disposed first and second ends, each of said light bulbs in said second set of light bulbs being inserted in said first end of a respective one of said openings and projecting out of said member through said second end of said respective opening.

10. An ornament for use with a string of holiday lights having a plurality of light bulbs disposed on a common electrical cord, the plurality of light bulbs including a first set of light bulbs that extend along the electrical cord in a longitudinal direction, the plurality of light bulbs further including a second set of light bulbs that extend in a transverse direction, the first set of light bulbs comprising light bulbs of a first color, the second set of light bulbs comprising light bulbs of the first color and light bulbs of a second color, the light bulbs of the first color and the second color being alternately disposed in the second set of light bulbs, said ornament comprising:

a member shaped in the form of a candy cane and made of a polymeric material, said member having oppositely disposed first and second ends;

said member including a plurality of openings disposed in succession along a curvilinear path between said first and second ends, said plurality of openings for receiving the second set of light bulbs;

said plurality of openings including a first group of openings for receiving the light bulbs of the first color and a second group of openings for receiving the light bulbs of the second color, said openings in said first group of openings and said openings in said second group of openings being alternately disposed along said curvilinear path.

11. The apparatus of claim 10 wherein said member has a main body portion through which said plurality of openings extend, said main body portion including a plurality of alternately disposed first and second sections, each of said first sections of said main body being a third color, each of said second sections of said main body portion being a fourth color.

12. The apparatus of claim 11 wherein each of said first set of openings is located in one of said first sections of said main body portion and each of said second set of openings is located in one of said second sections of said main body portion.

13. The apparatus of claim 12 wherein each of the light bulbs of the first color in the second set of light bulbs are disposed in one of said openings in said first set of openings in one of said first sections of said main body portion, each of the light bulbs of the second color in the second set of light bulbs being disposed in one of said openings in said second set of openings in one of said second sections of said main body portion.

14. The apparatus of claim 11 wherein the first color of the light bulbs in the second set of light bulbs is a shade of white and the second color of the light bulbs in the second set of light bulbs is a shade of red, the third color of said first sections of said main body portion being a shade of white and the fourth color of said second sections of said main body portion being a shade of red.

15. The apparatus of claim 10 wherein said member has a circular cross-section being either solid or tubular.

16. The apparatus of claim 10 wherein said member has a rectangular cross-section.

17. The apparatus of claim 10 wherein the electrical cord extending between each of the light bulbs in the second set of light bulbs is secured to said member.

18. The apparatus of claim 10 wherein each of said plurality of openings in said member has oppositely disposed first and second ends, each of the light bulbs in the second set of light bulbs being inserted in said first end of a second end of said openings and projecting out of said member through said second end of said respective opening.

* * * * *